US010427315B2

(12) United States Patent
Carrasco

(10) Patent No.: US 10,427,315 B2
(45) Date of Patent: Oct. 1, 2019

(54) METHOD FOR CUTTING A PROCESS MATERIAL UNDER THE APPLICATION OF ULTRASONIC ENERGY AS WELL AS CUTTING DEVICE

(71) Applicant: A O SCHALLINOX GMBH, Schocherswil (CH)

(72) Inventor: César Carrasco, Schocherswil (CH)

(73) Assignee: A O SCHALLINOX GMBH, Schocherswil (CH)

( * ) Notice: Subject to any disclaimer, the term of this patent is extended or adjusted under 35 U.S.C. 154(b) by 65 days.

(21) Appl. No.: 14/890,638

(22) PCT Filed: May 12, 2014

(86) PCT No.: PCT/EP2014/059674

§ 371 (c)(1),
(2) Date: Nov. 12, 2015

(87) PCT Pub. No.: WO2014/184150

PCT Pub. Date: Nov. 20, 2014

(65) Prior Publication Data

US 2016/0114494 A1 Apr. 28, 2016

(30) Foreign Application Priority Data

May 13, 2013 (EP) ..... 13167560

(51) Int. Cl.
*B26D 7/08* (2006.01)
*B26D 3/16* (2006.01)
(Continued)

(52) U.S. Cl.
CPC ..... *B26D 7/086* (2013.01); *B26D 1/06* (2013.01); *B26D 3/161* (2013.01); *B26D 5/005* (2013.01);
(Continued)

(58) Field of Classification Search
CPC . B26D 7/086; B26D 1/06; B26D 1/08; B26D 1/09; B26D 2210/02; B26D 3/16; B26D 3/161; B26D 5/005
See application file for complete search history.

(56) References Cited

U.S. PATENT DOCUMENTS 5,768,970 A * 6/1998 Wolf ..... A21C 11/10 83/701
6,701,055 B2 * 3/2004 Yasuda ..... B26D 1/04 385/134
(Continued)

FOREIGN PATENT DOCUMENTS

DE 102005006506 A1 7/2006
DE 102009045945 A1 4/2011
(Continued)

OTHER PUBLICATIONS

Sep. 19, 2014 International Search Report issued in International Patent Application No. PCT/EP2014/059674.

*Primary Examiner* — Stephen Choi
(74) *Attorney, Agent, or Firm* — Oliff PLC

(57) ABSTRACT

The method serves for operating a cutting device, which is designed for cutting a process material, particularly foodstuff and which has at least one blade, which is driven by a drive device and to which ultrasonic energy is supplied from a ultrasound unit via at least one energy converter and a coupling element. A control unit is provided, which controls the ultrasound unit in such a way, that the frequency of the ultrasonic energy which is supplied to the blade via only one coupling element is keyed between at least a first and a second operating frequency or that the ultrasonic energy is supplied to the blade via a first coupling element with a first operating frequency and via a second coupling element with
(Continued)

a second operating frequency, which frequencies are fixed or keyed between at least two operating frequencies.

4 Claims, 7 Drawing Sheets

(51) Int. Cl.

| | |
|---|---|
| ***B26D 5/00*** | (2006.01) |
| ***B26D 1/06*** | (2006.01) |
| *B26D 1/08* | (2006.01) |
| *B26D 1/09* | (2006.01) |

(52) U.S. Cl.
CPC ..... *B26D 1/08* (2013.01); *B26D 1/09* (2013.01); *B26D 3/16* (2013.01); *B26D 2210/02* (2013.01)

(56) References Cited

U.S. PATENT DOCUMENTS

| | | | | |
|---|---|---|---|---|
| 2009/0326609 | A1* | 12/2009 | Doron | A61B 5/0031 607/60 |
| 2010/0288092 | A1* | 11/2010 | Manger | B26D 7/086 83/13 |
| 2011/0253480 | A1* | 10/2011 | Goodman | G01M 13/028 184/36 |
| 2012/0267135 | A1 | 10/2012 | Roser | |
| 2014/0116222 | A1 | 5/2014 | Carrasco | |
| 2014/0249555 | A1 | 9/2014 | Kising | |
| 2014/0290394 | A1* | 10/2014 | Grossmann | G01D 3/08 73/865.8 |

FOREIGN PATENT DOCUMENTS

| | | | |
|---|---|---|---|
| EP | 2551077 | A1 | 1/2013 |
| WO | 2013/068123 | A1 | 5/2013 |

* cited by examiner

METHOD FOR CUTTING A PROCESS MATERIAL UNDER THE APPLICATION OF ULTRASONIC ENERGY AS WELL AS CUTTING DEVICE

The invention relates to a method for cutting a process material, particularly foodstuff, such as meat, cheese, vegetables, bread or pasta, under the application of ultrasonic energy as well as a cutting device that is operating according to this method and that comprises a blade to which ultrasonic energy is applied.

In numerous industrial applications, particularly in the food industry, products need to be provided with predetermined dimensions. Bread, meat products, particularly sausages, or cheese are often cut in slices and packed. For this purpose, different cutting devices are used in the industry.

[1], DE102005006506A1, discloses a cutting device with a vertically vibrating sewing blade that is used for cutting purposes. The amplitude of the vibration and the vibration frequency of the sewing blade are variably adjustable within given limits. The sewing blade is driven by a vibrating motor that is integrated in a housing. The vibrating motor drives the sewing blade in such a way that it executes a continuous movement up and down. The path, which the sewing blade traverses, is thereby adjustable between 1/10 mm and 5 mm. With such a cutting device a process material can normally not be cut in a desired quality. Further, by the impact of the vibrating motor it is expected that the blade is exposed to severe strain.

Advantageously, process material can be processed with a cutting device including a knife to which ultrasonic energy is applied. A device of this kind is disclosed in [2], EP2551077A1. Ultrasonic energy provided by a ultrasound converter is applied to the knife via at least one bow shaped, preferably U-shaped coupling element, which on one side is welded to the back of the blade and is connected on the other side, e.g. via a threaded bore and a coupling screw, to the ultrasound converter. The described cutting device allows processing a process material more quickly and precisely compared to conventional systems.

When handling this cutting device, the user selects the operating parameters, which shall be applied when using the knife. These operating parameters depend particularly on the process material, which needs to be processed or cut in pieces respectively. Particularly the clock cycles are selected, with which the knife is periodically moved. Within an operating cycle the knife is either rotated or moved forth back. However the clock cycles can only be increased within the range in which the quality of the executed cuts is maintained. As soon as the process material exhibits deformation or fissures, the cutting speed must be reduced.

If the consistency of the process material changes during continuously executed cutting, then quality deficiencies may occur. If the user has tuned the cutting process to a process material and a first charge has been processed, quality deficiencies can occur when processing a further charge, if it exhibits other properties.

The cutting device disclosed in [2] can be equipped with a long knife, which is held on both sides and can be driven perpendicularly to its alignment upwards and downwards, in order to alternatingly cut process material that is supplied above and below the knife. Knives of this kind are difficult to produce and therefore expensive. However, under optimal conditions these knives can be used for a long time. But, if operating parameters for a process material have incorrectly been selected, the knives are exposed to higher strain. Device parts can get hot and defects can occur.

[3], DE102009045945A1, discloses an electric power tool, which comprises a drive device for ultrasonic excitation of a tool, wherein a device for delivering an information signal is provided, whose frequency and/or amplitude is varied depending on the operating parameters of the electric power tool. During operation of the electric power tool a soft vibration with small amplitude that can be sensed by the user is applied to the grip member, in order to indicate the current operation mode, without impairing handling of the electric power tool. For production apparatuses that are operated fully automated this solution is however not applicable.

Within scans or sweeps the optimum frequency in view of the power applied is only once generated, while outside this frequency points numerous frequencies are generated that are less favorable. Hence, the properties of the cutting device and the cutting quality of the blade change during a frequency sweep.

The present invention is therefore based on the object, of providing an improved method for cutting a process material under the application of ultrasonic energy as well as providing an improved cutting device with a blade, that operates according to this method.

With the inventive method the blade shall be operated as long as possible in an optimum operating point. Further, the blade shall be operated as gently as possible, so that strain and wear are avoided.

It shall be possible to operate the cutting device with higher efficiency, particularly with higher clock cycles.

The process material shall be cut with high precision, high clock cycles and consistently high cutting quality. The cut products, particularly slices of food, shall exhibit plane cut surfaces and even thicknesses. Thereby, the precision shall be maintained when the consistency of the supplied foodstuff or food units delivered in parallel thereto changes.

In the event that changes of the properties of the process material occur, particularly when processing different charges of a process material, no quality deficiencies and no higher strain on the blade or further device parts shall occur.

This object is reached with a method for cutting a process material under the application of ultrasonic energy and a cutting device operating according to this method comprising the features defined in claim 1 or 13 respectively. Advantageous embodiments of the invention are defined in further claims.

The method serves for operating a cutting device, which is designed for cutting a process material, particularly foodstuff and which has at least one blade, which is driven by a drive device and to which ultrasonic energy is supplied from an ultrasound unit via at least one energy converter and a coupling element.

According to the invention a control unit is provided, which controls the ultrasound unit in such a way, that the frequency of the ultrasonic energy which is supplied to the blade via only one coupling element is keyed between at least a first and a second operating frequency or that the ultrasonic energy is supplied to the blade via a first coupling element with a first operating frequency and via a second coupling element with a second operating frequency, which frequencies are fixed or keyed between at least two operating frequencies.

The inventive application of ultrasonic energy allows the blade to cut the process material with little energy requirement and practically without force. The surface waves occurring on the blade split the structure of the process material before the blade is moved deeper into the process material. This allows rapid intrusion of the blade without causing deformation of the process material.

Due to the keying of the operating frequencies or the coupling of two different operating frequencies, an even distribution of the applied ultrasonic energy results along the cutting edge of the blade. Wave nodes of standing waves, which occur with the first frequency, are superimposed or superseded by antinodes, which occur with the second frequency. The cutting edge resonates therefore without gap, wherefore an optimal effect is reached when the blade penetrates the process material. Stationary nodes, at which ultrasonic energy has no effect, are avoided.

By keying between at least two preferred operating frequencies, at which good or optimum coupling of ultrasonic energy into the blade is reached, it is ensured, that the blade is always optimally operated. A scan or sweep of the ultrasound frequency can be avoided, so that unfavorable ranges of ultrasound frequencies are not traversed. Hence, according to the invention always an optimal operating frequency is selected, while during a scan or sweep stepwise a large number of different frequencies are selected, of which only a few provide optimal results.

The blade can be moved forth and back or can as well be rotated in a plane, which is perpendicular to the drive axis. Further, combined cutting movements are possible. E.g., the blade may be moved forward and then laterally. When rotating the blade it need not be decelerated and accelerated again but can be rotated without energy losses continuously in the same direction. Control of the operating cycles of the knife can simply be done by controlling the drive motor. Thereby, the maximum operating frequency is not determined by the capability of the drive device, but by the maximum cutting speed, with which the blade can be guided through the process material. Since this maximum cutting speed is very high under the inventive application of ultrasonic energy, very high clock cycles can be reached.

With the cutting device any process material can be processed or cut. Particularly foodstuff, e.g. meat, bread, pasta, dairy products, paper, cardboard, plastic, metal, precious metals, e.g. gold and silver, can advantageously be cut with this cutting device.

The application of ultrasonic energy e.g. with operating frequencies in the range of e.g. 30-40 kHz provides particularly advantageous properties to the inventive knife. The ultrasonic energy is preferably coupled into the large side planes of the back of the blade perpendicularly to the cutting direction of the knife. Thereby, an end piece of the coupling element that is facing the blade extends preferably perpendicular to the blade. During the application of ultrasonic energy, elastic waves result within and/or on the surface of the blade, which intensify towards the cutting edge. Particularly advantageous waves result with a curved or bent embodiment of the coupling element, which is preferably U-shaped.

The blade can exhibit cutting edges on one side or on opposite sides. Thereby, the cutting device is designed in such a way, that the blade can be moved or rotated in both directions and can be guided towards the process material.

When using a rotating blade, it is connected to a drive axis which is supported by at least one bearing element, which drive axis is connected directly or indirectly via drive elements, such as tooth wheels and tooth belts, with a drive unit, e.g. an electro motor. Further, the drive axis supports the energy converter or the energy converter and the ultrasound unit. In principle it is only required that the energy converter, which is connected to the coupling element, e.g. a piezo element, is rotated together with the drive axis. Only in preferred embodiments the ultrasound unit is also connected to the drive axis and rotated as well.

Energy and/or control signals can be transferred to the energy converter and/or to the ultrasound generator or a thereto connected and also pivotally held control unit via an electrical coupling unit. Control signals can also be transferred via a radio interface, e.g. operating according to the Bluetooth-method. An optical transmission of control signals is also possible.

With a rotating blade ultrasonic energy is transferred via a coupling element or via two coaxially aligned coupling elements, which are aligned perpendicular to the blade. With a blade that is moved forth and back ultrasonic energy can be coupled via a coupling element or via a plurality of coupling elements. Preferably a coupling element is provided on both sides of the blade each. Ultrasonic energy with a first and a second frequency can be coupled into the blade via coupling elements that are separated from one another.

According to the invention the operating frequencies are selected under consideration of the maximum values of the amplitudes, optionally according to the resonant frequencies that occur when the blade is penetrating the process material.

For this purpose, preferably an energy converter or a sensor is provided, which senses mechanical ultrasound waves that occur on the blade and which converts said waves into corresponding electrical signals that are evaluated e.g. in a signal processor.

The maximum values or the resonant frequencies are preferably determined, while the process material is cut. By means of the determined maximum values or resonant frequencies the operating frequencies can advantageously be set. If two or more maximum values or resonant frequencies, i.e. a global maximum and a local maximum of the measured amplitudes occur, then the operating frequencies can be switched or keyed between these two resonant frequencies or maximum values. In this case the blade operates always at resonance or at maximum values. If only one maximum value is occurring in the whole frequency spectrum of the blade and in the operating range, then a first operating frequency can be set to the resonant frequency and a second operating frequency can be set into the neighboring range of the resonant frequency in such a way, that also at the second operating frequency only minimum losses occur. Alternatively operating frequencies are selected, of which one is set below and the other is set above the resonant frequency. The distances from the resonant frequencies are selected in such a way, preferably equal or unequal, that lowest possible losses occur and simultaneously the required shift of the standing wave or nodes is reached. Distances between the operating frequencies are selected for example in a range of preferably 5 Hz to 10 kHz.

Keying between the first and the second operating frequency can be done symmetrically or asymmetrically in time. E.g. during a longer first time interval the preferred operating frequency and during a shorter second time interval the operating frequency is selected, which deviates from the resonant frequency or by which higher losses occur.

Keying between the operating frequencies is done with a keying frequency that is preferably in a range from 2 Hz to 500 Hz. All parameters, particularly the keying frequency, are preferably selected depending on the consistency of the process material and/or the molecular structure of the process material and/or the cutting speed. Hence, also with higher cutting speed it can be ensured, that by the interferences of two stationary operating frequencies or keyed operating frequencies a cut can correctly be executed, without the occurrence of disturbing nodes in the cutting area, at which the material is compressed and cut with a delay only. When cutting soft process material normally a higher keying frequency is selected. However, a higher keying frequency may also be selected when cutting crystalline process material.

For optimizing the cutting quality measurements are performed before and/or preferably during the cutting process. By means of these measurements the oscillation behavior of the blade is detected, which occurs when applying ultrasonic energy with a specific frequency. Of particular interest is the behavior of the blade while the blade is guided through the process material.

In preferred embodiments the blade is connected directly or via one of the coupling elements with a sensor, preferably a converter element, with which oscillations of the blade are sensed, converted and transferred as electrical signals to the control unit and are evaluated there. In this way the oscillation behavior of the blade can be determined over the complete frequency range or operating range.

By means of the sensors the oscillation amplitude of the blade and/or the phase of the oscillations of the blade in relation to a reference signal and/or the decay of the oscillations of the blade can be determined, which normally follows an exponential curve. As reference signals serve for example ultrasound waves provided by the ultrasound converter. Data are gathered particularly for new or already determined resonant frequencies, operating frequencies and/or for new test frequencies.

In a preferred embodiment a broadband pulse is applied to the blade as test signal, whereafter the resulting oscillations are measured. E.g. a signal with a plurality of frequencies is applied to the blade, of which preferably one corresponds to the operating frequency. Subsequently the resulting oscillations, which decay faster or slower, can be evaluated e.g. by a Fourier-transformation, in order to determine resonant frequencies and their amplitudes as well as decay times.

Alternatively the frequency response of a frequency sweep is measured by traversing the relevant frequency range with an ultrasound signal and resulting oscillations are sensed.

After determining the frequencies, at which the blade exhibits good or optimal oscillation behavior, the operating frequencies are set to these frequency values or are shifted in ranges, for which maximum amplitudes and/or a reduced phase shift and/or a slower decay of the oscillations has been found.

Measurements are executed continuously or in intervals, whereby the operating frequencies are preferably optimized, while the blade is guided through the process material.

The ultrasonic energy derived from the blade is preferably received in intervals, in which no ultrasonic energy is applied to the blade, or in which the ultrasound oscillations applied to the blade exhibit a zero crossing.

Alternatively ultrasonic energy is continuously applied to the blade, whereafter a corresponding share of the applied ultrasonic energy is subtracted from the received ultrasonic energy, in order to determine the natural frequency of the blade.

In preferred embodiments the control unit is designed in such a way, that the amplitude of the ultrasound waves applied to the blade can be controlled or regulated, in order to be able to apply a desired power level to the blade.

In preferred embodiments, optimization of the operating frequencies is done first. Subsequently readjustment of the oscillation amplitudes to desired values is done. This readjustment of the resulting oscillation amplitude can again be examined by measuring the oscillation behavior of the blade.

In addition, in preferred embodiments, at least a temperature sensor, e.g. an infrared sensor, is provided, with which the temperature of the sonotrode or blade or the coupling elements can be measured preferably contactless. The temperature is preferably measured particularly in the range of locations at which transitions are present and ultrasonic energy is coupled from a first into a second medium. During operation of the cutting device, particularly during the adjustment of the amplitude the ultrasound waves, the temperature is preferably observed in order to detect mismatches or further deficiencies. As soon as a temperature rise or a high power consumption of the blade is detected, an alarm can be issued and the cutting device can be switched off. Alternatively the applied ultrasound power can be reduced when a maximum temperature is exceeded. Subsequently the cutting device, the process material and/or the process parameters are examined, in order to find error causes.

The inventive method can advantageously be applied on cutting devices that use blades for cutting a process material. However the inventive method can also advantageously be applied in devices that use different sonotrodes, with which process material, such as foodstuff or pharmaceutical products are processed. E.g. the inventive method can advantageously be used with devices with a blade as sonotrode that however is not used for cutting, but for atomizing or transporting a process material. E.g. the inventive method can be used with devices having a sieve as sonotrode, with which e.g. a foodstuff or a pharmaceutical substance is sieved. Thereby it is avoided that nodes can remain in the range of individual pores of the sonotrode or of the sieve.

The inventive cutting device can be coupled to any further device in order to cut a process material. The cutting device is arranged for example at the end of a conveyor chain, at which a process material shall be cut to pieces. With great advantage the inventive cutting device can also be arranged at the output of an extruder so that extruded material can be cut optionally in shorter or longer elements. Thereby, a single cutting device can serve a plurality of extruders or conveyor devices. Hence, an inventive device can be equipped with a sonotrode that can fulfill different tasks, such as cutting, filtering, sieving, atomizing, transporting and fluidizing, e.g. fluidizing bulk material.

Below the invention is described with reference to drawings. Thereby show:

FIG. 1 shows an inventive device for cutting a process material 8A, 8B, which is conveyed below and above a blade 11 that is held by a drive device 12 and that receives ultrasonic energy transferred via two ultrasound converters 13 from a ultrasound unit 4 which is further designed to receive ultrasound signals that are derived from the blade 11;

FIG. 2 shows an inventive device for cutting a process material 8, comprising a cutting device 1 with four blades 11A, . . . , 11D, with which a process material 8, that is supplied in form of bars 8A, . . . , 8L to a conveyor table 93, is cut in slices 89;

FIG. 3 shows the cutting device 1 of FIG. 2, with two drive units 12A, 12B with which the blades 11A, . . . , 11D can be moved upwards and downwards;

FIG. 4*a* shows a blade 11 with a coupling element 15, on which a first energy converter 131 is arranged, which is supplied with ultrasonic energy, and on which a second energy converter 132 is arranged that seizes ultrasound waves occurring on the blade 11 and that converts these ultrasound waves into electrical signals that are evaluated by the control unit 6;

FIG. 4*b* shows a spectrogram with an ultrasound pulse TP with oscillations of a plurality of frequencies f1, f2 and f3 that are applied to the blade 11 as well as the slope of the oscillations, which are then measured and evaluated;

Figure 5:
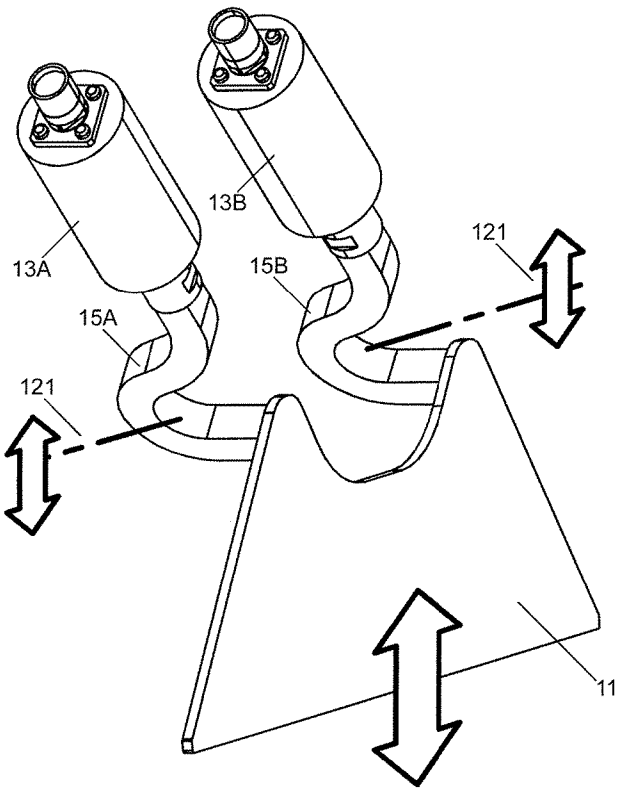
FIG. 5 shows the blade 11 of FIG. 4*a* with two coupling elements 15A, 15B that are connected to ultrasound converters 13A, 13B.
Figures 7A, 7B, 7C:
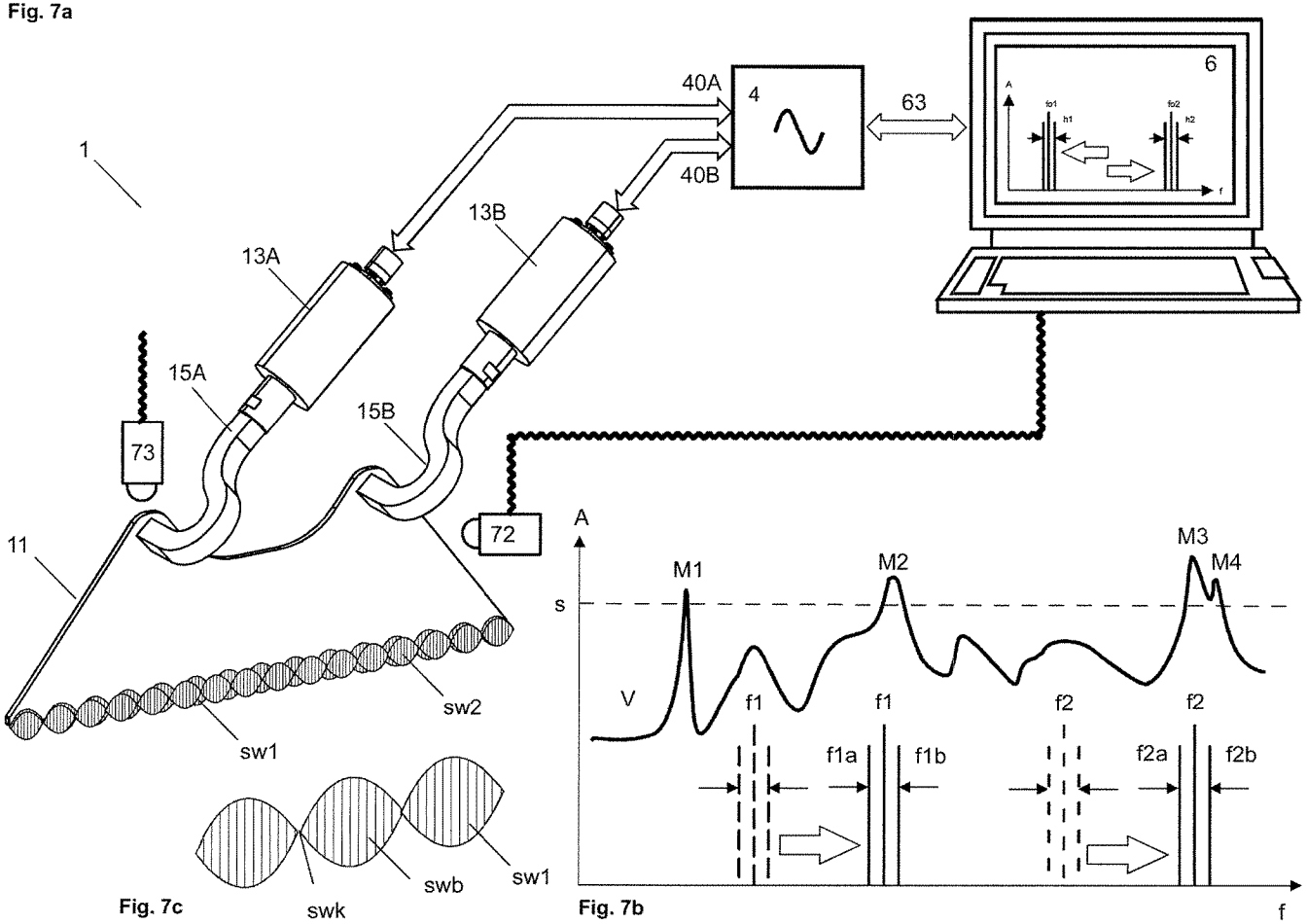
Figure 8:
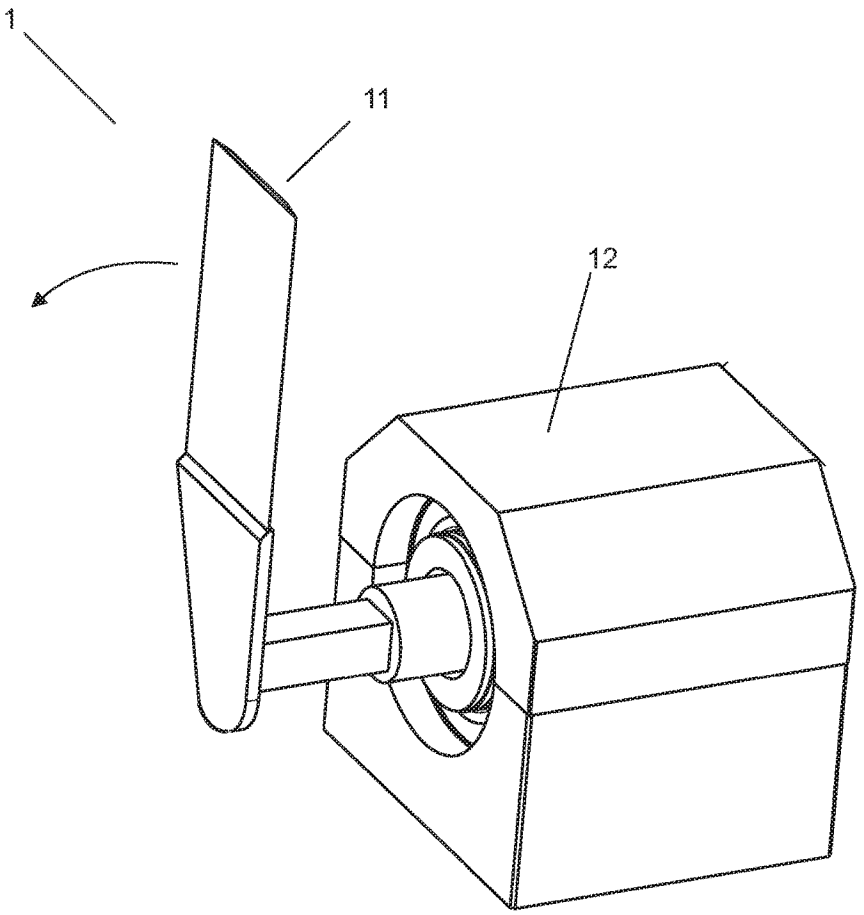

FIG. 7*a* shows the blade 11 of FIG. 5 with the ultrasound converters 13A, 13B that are connected to the ultrasound unit 4, which receives and transmits ultrasound signals;

FIG. 7*b* shows a frequency diagram with frequencies f1, 11*a*, f1*b*; f2, f2*a*, f2*b*, which are optimized by examining the oscillation behavior of the blade 11 or by means of the frequency response V of the blade 11;

FIG. 7*c* shows standing waves sw1 that occur on the blade and that exhibit nodes swk and antinodes swb; and FIG. 8 shows an exemplary embodiment where the device 1 includes a movable or rotatable blade 11 that is held by a drive device 12.

Figure 1:
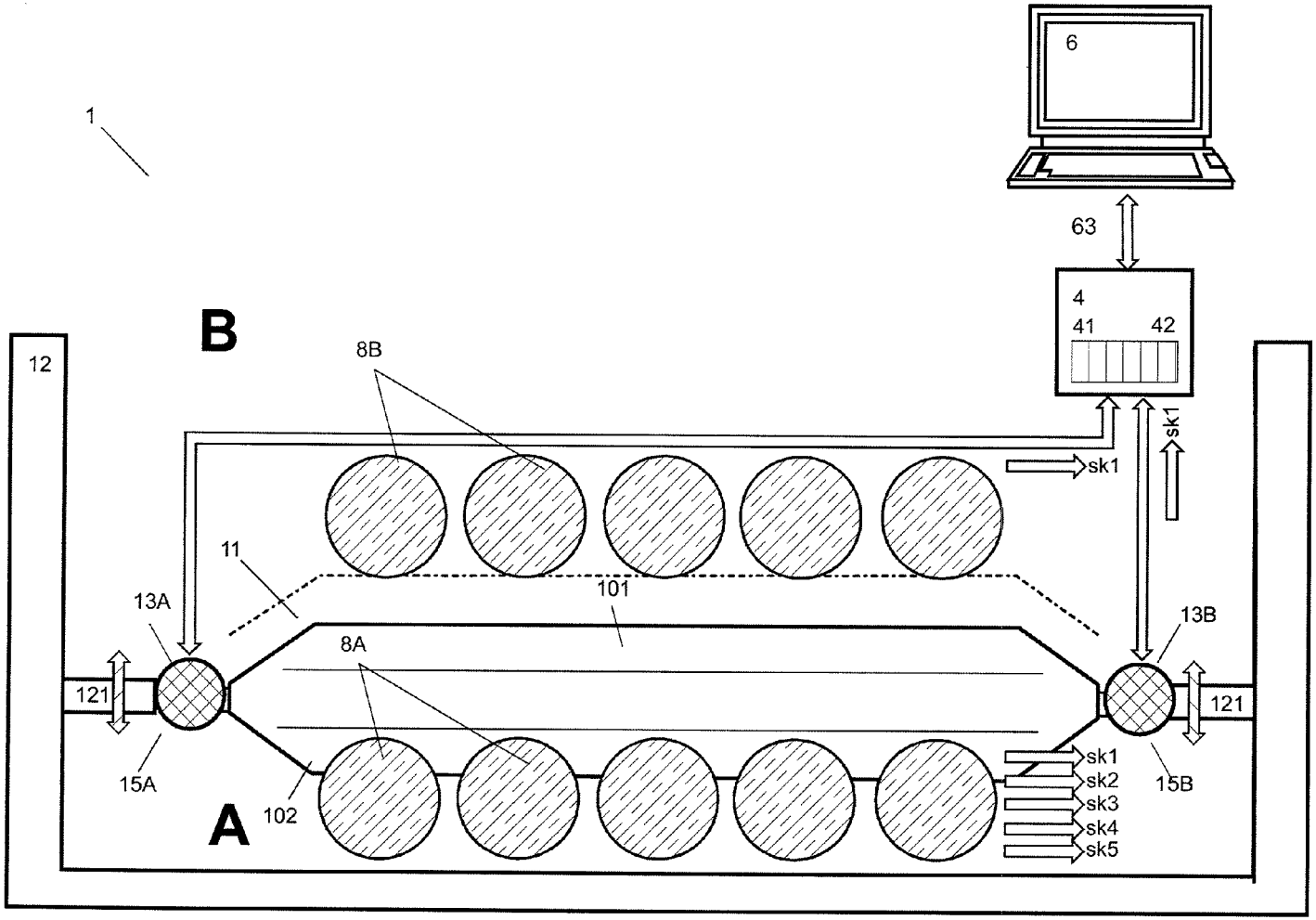

FIG. 1 shows a device 1 for cutting a process material 8A, 8B, which is supplied below and above a cutting tool or a blade 11 that is held by a drive device 12. It is shown that the drive device 12 holds the blade 11 on both sides with holding arms 121, which can synchronously be moved vertically downwards and upwards. The holding arms 121 can be connected with holding elements that are fastened to the blade 11. Preferably, the holding arms 121 can be moved with the coupling elements 15A, 15B, via which ultrasonic energy is coupled into the blade 11 (see FIG. 5).

By means of the drive device 12 the blade 11 can be moved downwards and upwards, in order to cut in each direction of movement a first or a second portion of the supplied process material 8A, 8B respectively. For this purpose, the blade 11 comprises an upper cutting edge 101 and a lower cutting edge 102. In another exemplary embodiment, as shown in FIG. 8, by means of the drive device 12, the blade 11 can be rotated in a plane, which is perpendicular to the drive axis.

For the implementation of the inventive method the cutting device 1 comprises a correspondingly designed control unit 6, a correspondingly designed ultrasound unit 4 and correspondingly designed ultrasound converters 13*a*, 13*b*. The ultrasound converters 13*a*, 13*b* are connected, preferably welded, by means of coupling elements 15A, 15B to the blade 11. In principle, every coupling or every embodiment of the coupling elements 15A, 15B can be used for the implementation of the inventive method.

The ultrasound unit 4, which communicates with the control unit 6 and which is controlled by the control unit 6, comprises at least one transmission channel 41 and preferably at least one receiver channel 42. A transmission channel 41 comprises e.g. a fixed or variable oscillator, e.g. a voltage controlled oscillator VCO or a synthesizer. By means of the preferably controllable oscillators or synthesizers frequencies are selectively generated in the ultrasound range and are preferably supplied to a controllable output amplifier, as described below with reference to FIG. 6.

A transmission channel 41 of the ultrasound unit 4 can be connected to a plurality of ultrasound converters 13A, 13B or energy converters 131 (see FIG. 6), which convert the electrical ultrasound oscillations into mechanical ultrasound oscillations that are applied via the coupling elements 15A, 15B to the blade 11. The ultrasound converters 13A, 13B can be supplied with identical ultrasound signals. Alternatively ultrasound signals with different frequencies can be supplied according to a time sharing method via switches to the ultrasound converters 13A, 13B. Further, for each ultrasound converter 13A or 13B a dedicated transmission channel 41 can be provided.

By means of the control unit 6 the ultrasound unit 4 is controllable in such a way, that the frequency of the ultrasound waves, which are applied to the blade 11, can be keyed between at least a first and a second operating frequency f1*a*, f1*b*. On both ultrasound converters 13A, 13B the same frequencies can be present, which are keyed preferably within a few milliseconds. However preferably the ultrasonic energy is supplied to the blade 11 via a first coupling element with a first operating frequency f1 and via a second coupling element with a second operating frequency f2, which are fixed or switchable between at least two operating frequencies f1, f2 or f1*a*, f1*b*; f2*a*, f2*b* (see the frequency diagram in FIG. 7*b*). Preferably different frequencies are applied to the two ultrasound converters 13A, 13B, so that a frequency mixture results on the blade 11 and nodes do not appear or only for a short period of time.

If only one coupling element is provided, then the frequencies f1, f2 or f1*a*, f1*b*; f2*a*, f2*b* are keyed according to a time sharing method. Alternatively two or more frequencies can be superimposed upon one another and can be coupled into the blade 11.

FIG. 1 shows further that in a preferred embodiment ultrasonic energy can be decoupled from the blade 11 and can be transferred via one or a plurality of receiving channels 42 provided in the ultrasound unit 4 to the control unit 6. As described below, the ultrasound oscillations sensed on the blade 11 are evaluated, in order to determine the oscillation behavior of the blade 11 with the selected process parameters.

FIG. 1 illustrates that preferably multiple measurements are executed during a cutting procedure. While the blade 11 traverses the process material 8A, signals sk1, . . . , sk5 are decoupled from the blade 11 in short intervals and are transferred via the receiver channel is 42 to the control unit 6. If optimal oscillation behavior of the blade 11 is detected, then the process parameters are not changed. However, if unfavorable oscillation behavior is detected, then the process parameters are changed in such a way, that the oscillation behavior is improved stepwise. Preferably, the process parameters are readjusted after every sampling of oscillations on the blade 11. Hence, while the blade 11 is guided through the process material 8, improvements and adaptions of the cutting processes can continuously be performed. Hence, the cutting process is not only in cases optimized, in which previous and following process material differ from one another. Corrections also apply for process material, which exhibits different properties across the cross-section or the cut surface.

With optimization and adaption not only a continuously high cutting quality, but also a minimum strain on the cutting device is reached. On the one hand partial blockages when applying a cut are avoided. On the other hand energy losses and a corresponding heating of the blade 11 is avoided.

Optimal oscillation behavior of the blade 11 appears in the range of the resonant frequency of the blade 11. Hence, as a starting point for the selection of the process parameters the resonant frequency of the blade 11 specified by the producer can be selected. Depending on the kind of process material 8 to be processed by the blade 11, the resonant frequency and therefore the oscillation behavior of the blade 11 will change, so that by means of the measurements of the signals sk1, . . . , sk5 illustrated in FIG. 1 a continuous optimization is pursued by determining the resonant frequency which currently occurs when processing a process material.

Particularly the global maximum within the frequency response of the blade 11 is determined. Also local maxima that appear within the frequency response can advantageously be determined. Then preferably frequency keying between the determined maxima is performed. It is taken care that the operating frequencies f1*a*, f1*b* or f1, f2 are selected and keyed in such a way, that resulting nodes swk do not overlap.

Operating frequencies are preferably selected in such a way, that the first and the second operating frequency f1*a*, f1*b* are set preferably in even frequency distance below and above the determined resonant frequency f1, or that a the first operating frequency f1*a* is set precisely at the resonant frequency f1 and the second operating frequency f1*b* is set in a range, in which only minimal damping occurs.

When using only one resonant frequency or only one maximum, the distance between the first operating frequency that is set to resonance or to the maximum and the at least one second operating frequency preferably is kept as small as possible and as large as required, so that stationary wave nodes are avoided and the ultrasonic energy can act across the whole cutting edge of the blade onto the process material. In this case a frequency distance is selected for example in the range from 5 Hz to 500 HZ. Preferably an asymmetric switching is provided with a higher rest time in the range of the frequency, at which higher amplitudes occur.

The distance between the operating frequencies f1*a* and f1*b* lies preferably in a range from 5 Hz to 10 kHz. Depending on the frequency response of the blade 11 smaller or larger frequency distances are selected.

Keying of the first and the second operating frequency f1*a*, f1*b* or f1, f2 is done with a keying frequency lying preferably in a range from 2 Hz to 500 Hz. The keying is executed symmetrically or asymmetrically in time. E.g. during a longer first time interval the resonant frequency is applied to the blade 11, while for a shorter second time interval an operating frequency is applied to the blade 11 which deviates from the resonant frequency. In this case during the first time interval the blade 11 shall be applied with optimal effect on the process material 8 and during the second time interval a removal of obstacles shall be reached, which remain after the first time interval.

As mentioned the inventive method can be used with different cutting devices or with further devices that comprise an ultrasound sonotrode.

Figure 2:
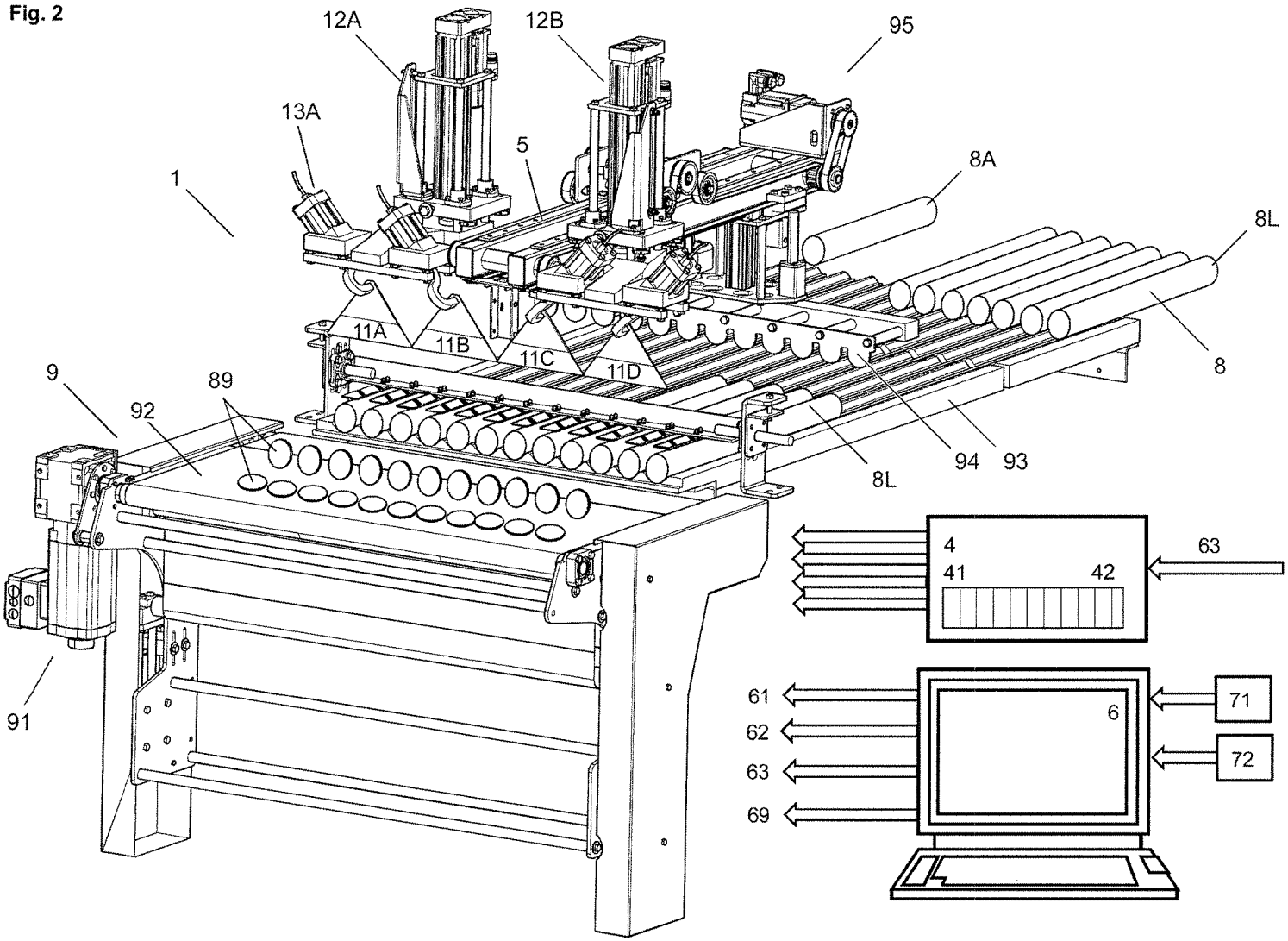

FIG. 2 shows a cutting device 1 with four cutting tools 11A, . . . , 11D, a pushing unit 95 with a pushing tool 94, two drive units 12A, 12B for driving the cutting tools 11A, . . . , 11D, and a conveyor table 93 on which the process material 8 is placed and pushed by means of the pushing tool 94 towards the cutting tools 11A, . . . , 11D. The cutting device 1 is held by a mounting structure 5.

The process material 8 consists of twelve cylindrical or bar-shaped units 8A, . . . , 8L that are guided in parallel towards the four cutting tools 11A, . . . , 11D, so that always three of the units of process material 8A, . . . , 8L are simultaneously cut by one of the cutting tools 11A; . . . ; 11D. At the front side the units of process material 8A, . . . , 8L, which are delivered in parallel, are held by a downholder in a desired position, while the cut is executed.

The cutting unit 1 comprises the four cutting tools 11A; . . . ; 11D, which are connected each to an ultrasound converter 13 and which can be vertically lowered and lifted again by the drive units 12A, 12B in order to cut slices 89 from the units of process material 8. The slices 89 fall onto a conveyor belt 92 of a receiving conveyor 9, which comprises a drive motor 91.

Further provided is a control unit 6 that controls the cutting device 1, the conveyor devices and the ultrasound unit 4. The control unit 6 is connected via a first control line 61 to the drive units 12A, 12B, a second control line 62 to the conveyor devices, a third control line 63 to the ultrasound unit 4 and a fourth control line 69 to the receiving conveyor 9. Via a keyboard and measurement devices 71, 72, such as transducers and sensors, information is supplied to the control device 6, with which the cutting process and the conveyor process can be controlled.

Figure 3:
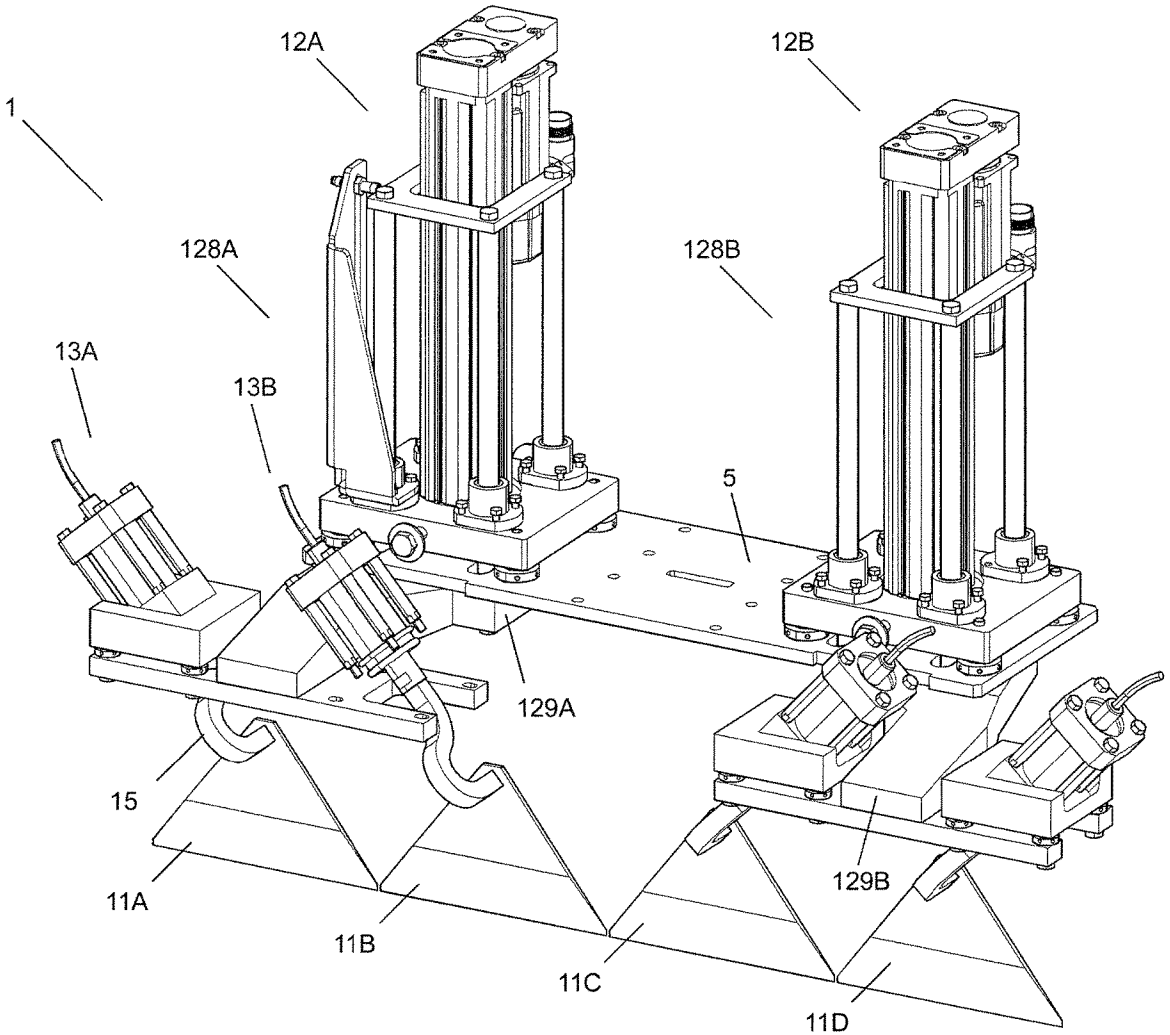

FIG. 3 shows the dismounted cutting device 1 of FIG. 1, which comprises two to identical cutting modules, which are held by a mounting plate that is part of a mounting structure 5 of the device. Each of the cutting modules comprises a drive unit 12A; 12B and a bearing structure 128A; 128B that is connected to the mounting structure 5 and that allows vertically lifting and lowering a related first or second bearing block 129A, 129B. Each bearing block 129A; 129B is equipped with two ultrasound converters 13A, 13B or 13C, 13D respectively, which are connected each via a coupling element 15 to a cutting tool 11A, 11B, 11C or 11D.

The cutting tools 11A, . . . , 11D comprise each a blade 11 with a blade back on which the curved coupling elements 15 are welded, whereby ultrasonic energy can be coupled into the blades 11.

Figures 4A, 4B:
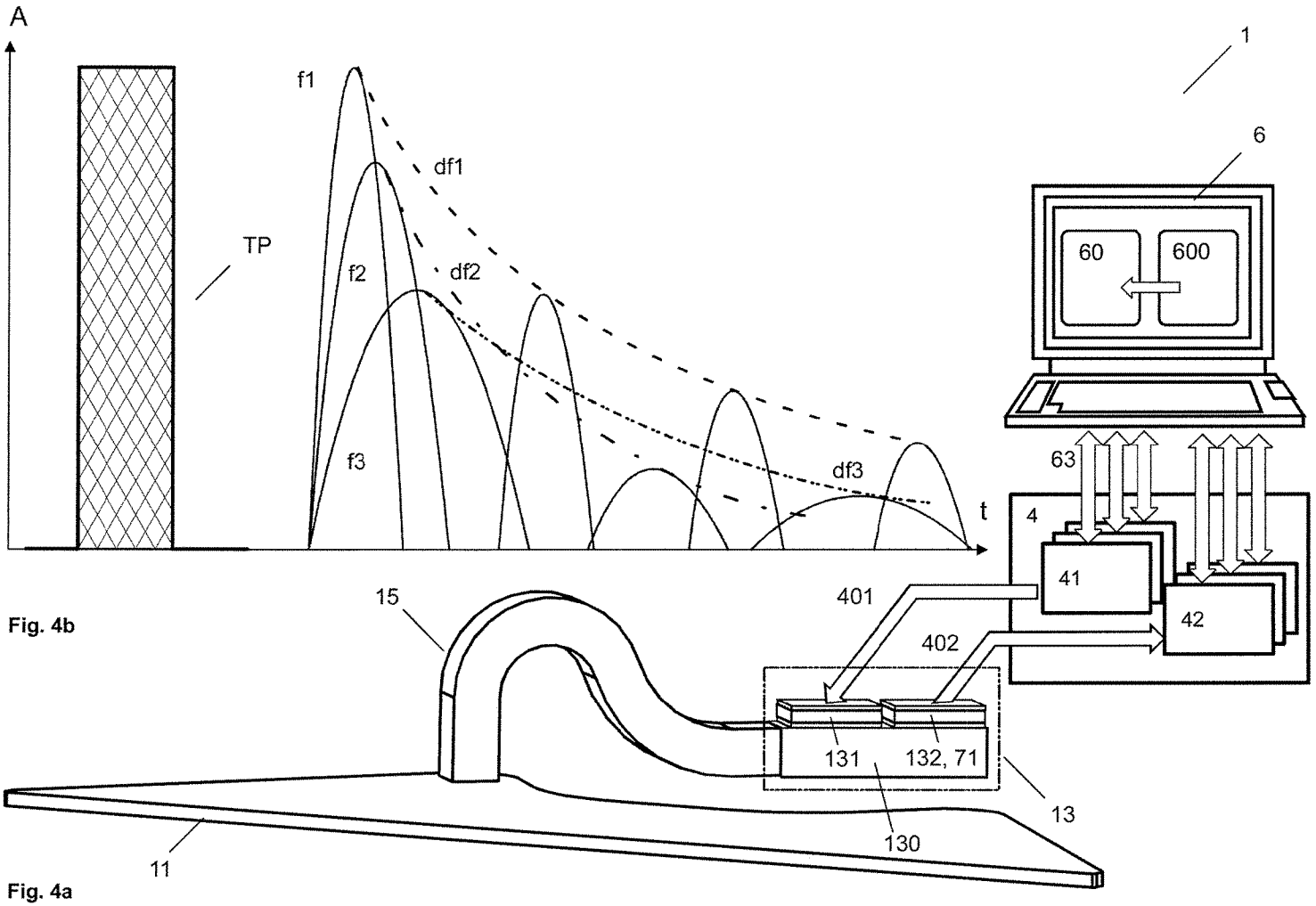

FIG. 4*a* shows that the coupling element 15 is connected, e.g. screwed to a beam 130, on which a first energy converter 131 is placed that is supplied with ultrasonic energy, and on which a second energy converter 132 is placed, that senses ultrasound waves appearing on the blade 11 and that converts these ultrasound waves into electrical signals, which are forwarded to the control unit 6. The beam 130, which together with the energy converters 131, 132 forms an ultrasound converter 13, comprises e.g. on the front side the screw, which is turned into a threaded bore that is provided in the coupling element 15. The ultrasound unit 4 comprise a plurality of transmission channels 41 and a plurality of receiver channels 42, so that a plurality of ultrasound converters 13 can be served.

The energy converters 131, 132 comprise preferably each a piezo element, which is enclosed between two electrodes, e.g. metal plates, of which one is seated on the beam 130 and the other is connected to an electrical line 401, 402. The transmission channel 41 of the ultrasound unit 4 provides electrical ultrasound signals via the connecting line 401 to the first energy converter 131. The second energy converter 132 or the sensor 71 senses mechanical ultrasound waves from the blade 11 and converts these mechanical waves into electrical ultrasound waves, which are forwarded via the second connecting line 402 to a receiver channel 42 of the ultrasound unit 4. The received ultrasound waves are amplified if required, filtered, converted and 4 forwarded to an evaluation module 600 in the control unit 6. The evaluation module 600 determines the current oscillation behavior of the blade 11 and compares it with specified values, whereafter correction measures are determined. E.g. it is determined, that at least one of the operating frequencies is shifted, or that the signal amplitude of at least one of the operating frequencies is increased or reduced. Corresponding information is forwarded from the evaluation module 600 to a control module 60, which determines the operating frequencies, the keying frequencies, the keying intervals and the signal amplitude and provides corresponding control signals. For controlling the evaluation module 600 and the control module 60 and operating program is provided, which controls the program sequence and communicates via interfaces with the user and external computers or electronic units.

Process optimization can be done in several ways. As mentioned the oscillation behavior of the sonotrode or the blade 11 is continuously observed and optimized. The control unit 6 can also automatically optimize the process parameters. For this purpose, the control unit 6 applies test signals TP to the blade 11 during the operation process or during test phases and evaluates echo signals f1, f2, f3. Evaluation of the test signals and the operating signals or operating frequencies, which are gathered during the process sequence, can be done in the same way.

FIG. 4*b* shows exemplarily a spectrogram with an ultrasound pulse TP, which comprises oscillations with a plurality of frequencies f1, f2 and f3. After the ultrasound pulse TP has been applied to the blade 11, the oscillation behavior of the blade 11 or the further sequence of the oscillations f1, f2 and f3 is examined. It is examined with which amplitudes the individual oscillations f1, f2 and f3 occur and how fast they decay. The curves df1, df2 and df3 show the slope of the decay of the oscillations f1, f2 and f3. After the evaluation module 600 has determined the frequencies, at which maximum oscillation amplitude and a minimum damping occur, the related information is forwarded to the control module 60.

If the frequency f2 is the operating frequency, then the test pulse TP is additionally provided with two frequencies f1, f3 for example, which are set below and above the operating frequency f2. By evaluating the echo signals of the three frequencies f1, f2, and f3 it can then be determined, that at frequency f1 a higher amplitude and a lower damping results. Hence, the evaluation module 600 will provide this information to the control module 60, whereafter with frequency f1 as new operating frequency an improved oscillation behavior of the blade 11 can be reached. The control module 60 can immediately take over frequency f1 as new operating frequency or include this information in the further evaluation process. Preferably, parameters are also taken into consideration for the evaluation, which relate to properties or expected changes of the process material 8.

FIG. 5 shows blade 11 of FIG. 4*a* with two coupling elements 15A, 15B that are connected to ultrasound converters 13A, 13B. In principle, ultrasound converters 13A, 13B can fully or partly incorporate ultrasound units 4. It is shown that blade 11 is held by the coupling elements 15A, 15B that are welded to the blade 11. The coupling elements 15A, 15B themselves are held by symbolically drafted holding arms 121, as has been described with reference to FIG. 1.

Figure 6:
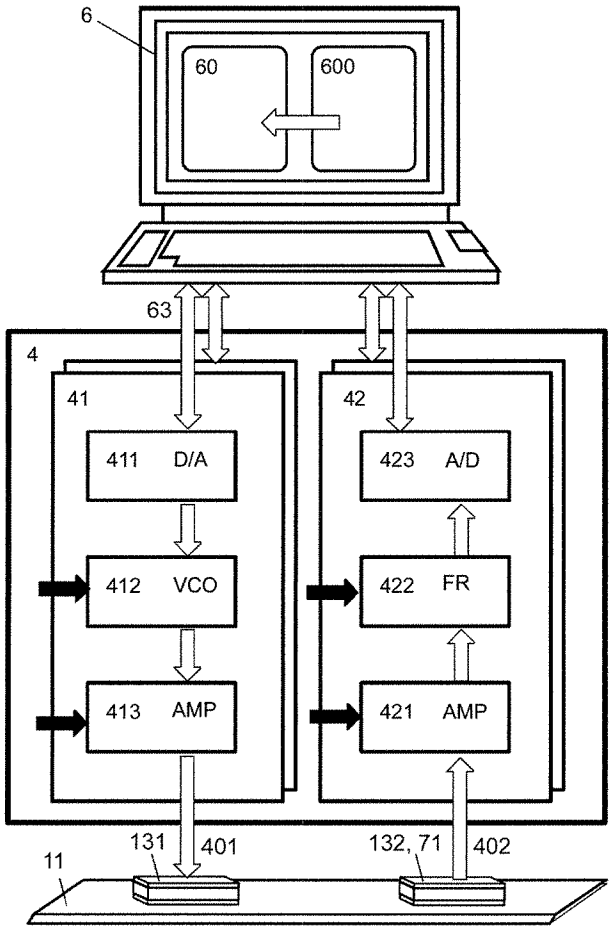
FIG. 6 shows a multichannel ultrasound unit 4 and the control unit 6 in a preferred embodiment.

FIG. 6 shows exemplarily the multichannel ultrasound unit 4, which is connected via a bus system 63 to the control unit 6 for exchanging data. The ultrasound unit 4 comprises two transmission channels 41 and two receiver channels 42.

Each transmission channel 41 comprises a D/A converter 411 that converts the digital commands of the control unit 6 into analogue control signals that are forwarded to the controllable oscillators 412. Instead, also a synthesizer can be used, which is directly controllable by the control unit 6 and which can simultaneously provide a plurality of operating frequencies. The oscillations delivered by the controllable oscillators 412 are forwarded each to a controllable amplifier 413, which delivers the oscillations with selectable amplitude to the energy converter 131. The control of the amplifier 413 is again performed by the control unit 6 or the control module 60. Hence, a plurality of ultrasound signals with selected frequency and selected amplitude can simultaneously be provided to the related energy converter 131 or ultrasound converter 13.

Each receiver channel 42 comprises preferably an input amplifier 421, preferably a filter stage 422 connected thereto that only lets pass frequencies of interest, as well as an A/D converter, which converts the analogue signals into digital data. The digital data are forwarded to the evaluation module 600, which comprises a signal processor for example and which is preferably suited to perform a Fourier-transformation.

FIG. 7*a* shows the blade 11 of FIG. 5 with the ultrasound converters 13A, 13B that are connected via connecting systems 40A, 40B to an ultrasound unit 4 that provides and receives ultrasound signals, as has been described above with reference to FIGS. 4*a*, 4*b* and 6.

It is shown, that the cutting device 1 is currently in operation and that two standing waves sw1, sw2 occur at the cutting edge of blade 11, which are superimposed upon one another, so that wave nodes swk of the one standing wave sw1 are located within the antinodes swb of the other standing wave sw2. The two waves sw1, sw2 can be superimposed upon one another or can be switched on alternatingly, so that always within a few milliseconds, optionally within fractions of a millisecond, each zone of the process material to be cut is exposed to the maximum intensity of the ultrasonic energy and an optimal cutting line is guaranteed. FIG. 7*c* illustrates the first standing wave sw1 with wave nodes swk and antinodes swb.

FIG. 7*a* further shows temperature sensors 72, 73, preferably infrared sensors, with which the temperature of the blade 11 or the coupling elements 15A, 15B, particularly the connecting points, can be observed. If a critical temperature rise is detected, then the power applied to the blade 11 can be reduced. Further, an examination procedure can be executed in order to detect inadequate process parameters. E.g. the frequency response of the blade 11 is recorded, in order to detect shifts of the resonant frequencies. In this way damage to the blade 11 can be avoided in good time.

FIG. 7*b* shows a frequency diagram with frequencies f1, f1*a*, f1*b*, f2, f2*a*, f2*b*, that are selectable by the control module 60. For determining the operating frequencies preferably the frequency response V of the blade 11 is recorded, which is shown in FIG. 7*b* as an example. It can be seen that the frequency response V exhibits four maxima that lie above a predetermined threshold s.

The maxima M1, . . . , M4 lie at locations at which ultrasonic energy can optimally enter the blade 11 and can cause oscillations in the blade 11. E.g. by piezo electrical elements, the mechanical oscillations are converted into electrical signals, whose voltage characteristic or amplitudes are shown in FIG. 7*b*.

Frequencies of the maxima located above this threshold s are suitable operating frequencies. M3 is the global maximum, while M1, M2 and M4 are local maxima. Now, the operating frequencies are selected in such a way that the wave nodes and the antinodes of the resulting standing waves overlap. In the present example, the operating frequencies f1 and f2 at the locations of the global maxima M3 and the local maxima M2 have been selected. Alternatively, further combinations of the frequencies of said maxima, e.g. M3 and M4 or M1, M2 and M4, or M1 and M4, can be selected. Alternatively a resonant frequency f1 is determined, whereafter on both sides of this resonant frequency f1 operating frequencies f1*a*, f1*b* are determined, which are forwarded to only one or both ultrasound converters 13A, 13B. It is shown that the maxima shift e.g. due to changes of the consistency of the process material 8 wherefore the operating frequencies f1, f2 or f1*a*, f1*b* are updated accordingly and consistently optimized according to the inventive method.

Preferably a plurality of recipes is provided, with which specific process parameters for a blade 11 and preferably a specific process material 8 are determined. Process parameters are for example the operating frequencies, the oscillation amplitudes preferably for each of the operating frequencies, the keying frequency, the minimum and maximum power, as well as the maximum temperature of the blade 11. Thereby, recipes can be selected and set permanently or sequentially or randomly. By measuring the oscillation behavior of the blade 11 for each recipe, optimal recipes can immediately be selected and applied. Hence, in preferred embodiments not only an individual process parameter, but a group of process parameters, optionally a whole recipe, is switched over.

Preferably the recipes are consistently optimized by means of the inventive measurement process and stored again. Hence, if changes of the process material 8 occur, suitable recipes can immediately be downloaded.

REFERENCES

[1] DE102005006506A1
[2] EP2551077A1
[3] DE102009045945A1

The invention claimed is:

1. A cutting device designed for cutting a process material with a drive device that is connected to a movable or rotatable blade, the cutting device comprising:

an ultrasound unit that provides ultrasonic energy to an energy converter, the energy converter being connected to the movable or rotatable blade via a coupling element; and a control unit that controls the ultrasound unit such that the frequency of the ultrasonic energy is keyed between at least a first operating frequency and a second operating frequency, wherein keying between the first operating frequency and the second operating frequency is performed with a keying frequency in a range from 2 Hz to 500 Hz.

2. The cutting device according to claim 1, further comprising:

at least one sensor that senses mechanical ultrasound waves that occur on the blade by the ultrasonic unit;

a converter that converts signals provided by the at least one sensor and transfers the converted signal to a signal processing module provided in the control unit, wherein the signal processing module evaluates the converted signal and gathers corresponding measurement results; and a control module, of the control unit, that controls the ultrasound unit according to the gathered measurement results, in order to further optimize the measurement results.

3. The cutting device according to claim 1, further comprising:

at least one temperature sensor that is connected to the control unit, and is mechanically coupled, directly or indirectly, with the blade, wherein the control unit is designed for observing the temperature of the blade or the temperature of the coupling element, and for controlling the ultrasound unit.

4. A cutting device for cutting a process material with a drive device that is connected to a movable or rotatable blade, the cutting device comprising:

an ultrasound unit, wherein the ultrasound unit provides ultrasonic energy with a first operating frequency to a first energy converter, the first energy converter being connected to the movable or rotatable blade via a first coupling element, and the ultrasound unit provides ultrasonic energy with a second operating frequency to a second energy converter, the second energy converter being connected to the movable or rotatable blade via a second coupling element; and a control unit that controls the ultrasound unit such that the first operating frequency and the second operating frequency are keyed between at least two operating frequencies, wherein keying between the at least two operating frequencies is performed with a keying frequency in a range from 2 Hz to 500 Hz.

* * * * *